US011492841B2

(12) United States Patent
Schleich

(10) Patent No.: US 11,492,841 B2
(45) Date of Patent: Nov. 8, 2022

(54) WINDOW DEVICE WITH A CEMENT BOARD AS A FRAME MATERIAL

(71) Applicant: Cindy L Schleich, Carmel, IN (US)

(72) Inventor: Cindy L Schleich, Carmel, IN (US)

( * ) Notice: Subject to any disclaimer, the term of this patent is extended or adjusted under 35 U.S.C. 154(b) by 0 days.

(21) Appl. No.: 17/221,789

(22) Filed: Apr. 3, 2021

(65) Prior Publication Data

US 2021/0317699 A1 Oct. 14, 2021

Related U.S. Application Data

(60) Provisional application No. 63/007,533, filed on Apr. 9, 2020.

(51) Int. Cl.

| | |
|---|---|
| ***E06B 3/26*** | (2006.01) |
| ***E06B 1/32*** | (2006.01) |
| ***E06B 3/64*** | (2006.01) |

(52) U.S. Cl.

CPC ..... *E06B 3/2605* (2013.01); *E06B 3/64* (2013.01); *E06B 1/32* (2013.01); *E06B 2003/2625* (2013.01)

(58) Field of Classification Search

CPC . E06B 3/2605; E06B 3/64; E06B 3/18; E06B 3/26; E06B 2003/2625; E06B 1/24; E06B 1/32; E06B 1/6007; E06B 3/302; E06B 3/303; E06B 3/304; E06B 3/305; E06B 3/306; E06B 3/307; E06B 3/308

USPC ..... 52/202

See application file for complete search history.

(56) References Cited

U.S. PATENT DOCUMENTS

| | | | | |
|---|---|---|---|---|
| 2,064,530 A * | 12/1936 | Gelstharp | E06B 3/64 | 52/209 |
| 2,670,508 A * | 3/1954 | Sylvan | E06B 3/2605 | 52/786.1 |
| 4,486,990 A * | 12/1984 | Bauch | E06B 9/02 | 49/490.1 |
| 4,625,479 A * | 12/1986 | Giguere | E06B 3/645 | 52/202 |
| 6,430,889 B1 * | 8/2002 | Nixon, Sr. | E06B 1/32 | 52/204.1 |
| 7,984,591 B2 * | 7/2011 | Cashin | E04C 2/34 | 52/63 |

(Continued)

FOREIGN PATENT DOCUMENTS

| | | |
|---|---|---|
| CN | 104912443 | 9/2015 |
| CN | 204738673 U | 11/2015 |

(Continued)

*Primary Examiner* — Kyle J. Walraed-Sullivan

(74) *Attorney, Agent, or Firm* — Ritchison Law Office PC; John D Ritchison

(57) ABSTRACT

A window device with a cementitious board as a frame material the device being a single or double window apparatus with an exterior configured with a cementitious board or structure and configured with such frames that are easily formed and readily adaptable to substantially any size or shape opening. The cementitious board window allows for a low maintenance, paintable or pre-painted panels that are moisture and rot resistant, are not susceptible to pest, and provide a surface which is durable over time, is non-combustible, and has materials with little environmental impact. The device is used with new or replacement windows for a commercial or residential structure.

16 Claims, 10 Drawing Sheets

(56) References Cited

U.S. PATENT DOCUMENTS 8,161,710 B2 * 4/2012 Elliott ..... F41H 5/02 52/745.05
8,413,387 B2 * 4/2013 Tatley ..... E06B 1/62 52/58
8,950,156 B2 * 2/2015 Vandehey ..... E04F 13/14 52/742.13
9,127,499 B2 * 9/2015 Lemons ..... E06B 1/32
2001/0042348 A1 * 11/2001 Lundahl ..... E06B 9/52 52/202
2003/0044550 A1 * 3/2003 Emek ..... E06B 1/6046 428/34
2003/0072899 A1 * 4/2003 Compton ..... E06B 3/2605 428/34
2006/0010788 A1 * 1/2006 Nettleton ..... E06B 1/70 52/58
2006/0070301 A1 * 4/2006 Fisher ..... E06B 1/34 49/504
2007/0107330 A1 * 5/2007 Culverson ..... E06B 3/2605 52/204.5
2007/0144085 A1 * 6/2007 Theios ..... E06B 3/6612 52/204.5
2010/0263305 A1 * 10/2010 Helton ..... E06B 7/16 52/169.14
2010/0293881 A1 * 11/2010 Betz ..... E06B 3/308 52/656.2
2017/0299347 A1 * 10/2017 Fultz ..... E06B 3/5454
2018/0142514 A1 * 5/2018 Alvarez ..... E06B 3/9644
2021/0207381 A1 * 7/2021 Maziarz ..... E06B 1/62
2021/0247077 A1 * 8/2021 Goldstein ..... E04F 13/072

FOREIGN PATENT DOCUMENTS

CN 106014148 A * 10/2016 ..... B32B 21/04
CN 104912443 B 11/2016
EP 2060725 B1 5/2011
JP 2007092409 A 6/2010

* cited by examiner 35,30
50
53A
53
55
60
51
51A
52
52A
55

35
50
35

Sect. A-A
See Figures: 6A, B, and C
38
51
40
37
41
36

55
45
30
53
40
43

50
41A
41
43
43A
45
60
A
A
42
42A
33,30

42
52
40
45
55
30

Sect. B-B

Sect. C-C

Sect. C-C

Repeated
B
B
C
C
30
33,35
41
41A
43
43A
45
50
51
51A
52
52A
53
53A
55
60
71
71,80
73
73,80
80

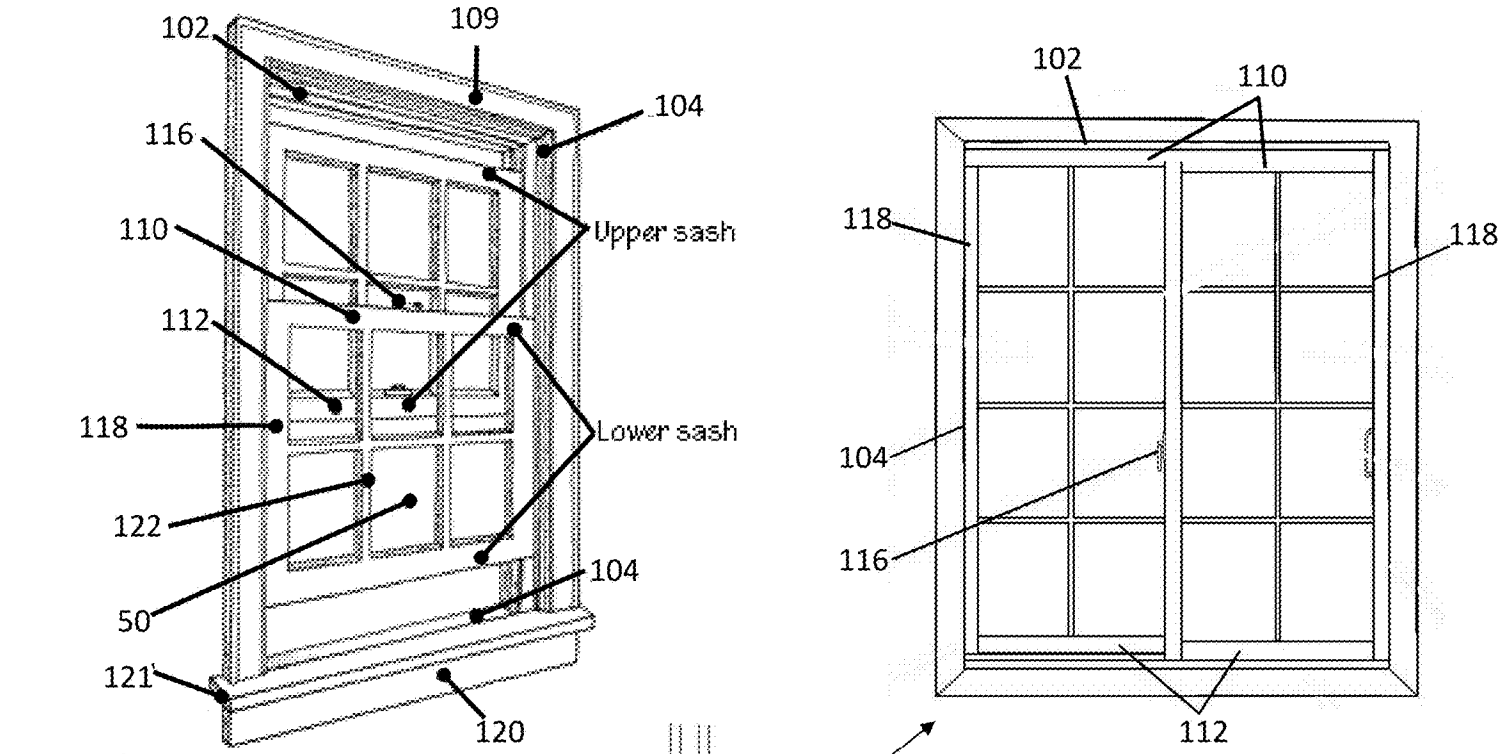
Fig. 9 A
Double Hung
Prior Art
Fig. 9 B
Side by Side Slider
Prior Art
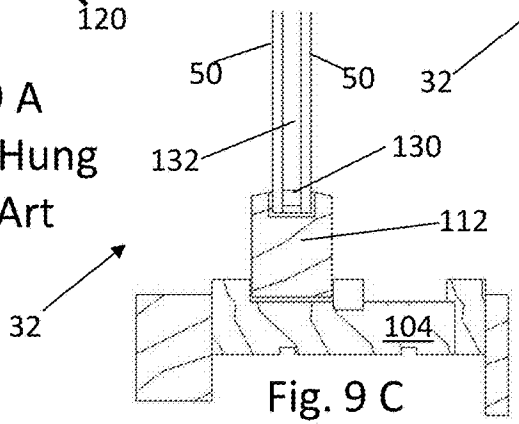
Fig. 9 C
Prior Art Head 102 - Prior Art Sill 104- Prior Art Section - Prior Art Jamb 106 - Prior Art

WINDOW DEVICE WITH A CEMENT BOARD AS A FRAME MATERIAL

CROSS-REFERENCE TO RELATED APPLICATIONS

This application claims the benefit of U.S. Provisional Patent Application with Ser. No. 63/007,533 filed Apr. 9, 2020, by Cindy L. Schleich. The application was entitled "A window device with a cement board (Hardie Weatherboard®) as a frame material."

FIELD OF INVENTION

The present invention relates to the field of windows. In particular, the present invention relates to a single or double window apparatus with an exterior configured with a cementitious board or structure such as that commonly known as "Hardie Weatherboard®" [RTM—Registered Trademark]. This device is a novel rectangular frame for providing stationary and movable windows with a superior exterior. The new device provides more value with less initial cost and lower maintenance expenses.

These new devices provide a paintable and maintenance friendly window. The present invention relates generally to window frames for buildings of all types, and more particularly to such frames as are easily formed and readily adaptable to substantially any size or shape opening. It relates to the field of prefabricated window panels, and more specifically to prefabricated panels having an exterior of a cementitious material. The applications anticipate original equipment and aftermarket uses described and discussed below.

FEDERALLY SPONSORED RESEARCH

None.

SEQUENCE LISTING OR PROGRAM

None.

BACKGROUND—FIELD OF INVENTION AND PRIOR ART

As far as known, there are no prior art of window devices with a cement board as a frame material or the like. It is believed that this product is unique in its design and technologies.

Background

There are many window and door structures in need of better waterproofing, paint ability, maintaining a vapor barrier, and/or aesthetic properties. In some cases, these are older structures whose designs or methods of construction are inadequate for cost effective maintenance considering present engineering standards and construction methods. In other cases, there are new structures under construction that could benefit from the development of new methods of external surfaces of windows and doors by modifying existing designs.

Buildings made with cementitious panels and siding are known and have been used in construction applications for commercial and residential structures. However, openings for doors and windows have not used the cementitious materials on the exterior. It is desired to have a building constructed of the typical cementitious panels and to now provide windows and doors with the exterior surfaces having cementitious materials as well. The rising costs of labor and materials have made increasingly desirable the use of cementitious exteriors for windows and door for not only commercial structures but homes. Economies of production line manufacture of prefabricated window and panels as well as ease of construction site erection would significantly reduce cost of labor. Also, considering energy costs, prefabricated building panels having good thermal insulating properties are especially desirable.

Problem Solved

The improvement and problems solved as to windows and door panels with cementitious exterior surfaces should be obvious to those aware of siding and panels in use in designs for construction today. Prefabricated windows could: be low maintenance, paintable, could come as pre-painted panels, are moisture and rot resistant, are not susceptible to pest, provide a surface that is durable over time, is non-combustible, and is environmentally friendly by using known materials available today with little environmental impact.

Prior Art

A novelty search revealed no other prior art that conflicts with this window device with a cement board (like a Hardie Weatherboard®) as a frame material for the exterior surface. The prior art found included:

A. A Chinese patent, CN104912443 was issued in 2016 for Fasting board bay window. It discloses a web plate windows to solve the problem of window frames for existing residential windows and is made of a cement board with a production process and cycle of the process of such a long, high production cost, and labor-intensive technical solution to attack the problem. Technical solutions are as follows: A web plate windows including roof windows, windows and two bottom post; windows and the top and bottom windows are disposed on the wall structure; windows between the top and bottom windows height of windows; two supporting uprights between windows and the windows and the bottom plate and the top plate is fixed to the bottom windows and roof windows.

B. A Chinese patent, CN104912443B was issued in 2018 for a Hollow-extrusion-molding-cement board curtain wall system and construction method thereof. The invention relates to a construction method for a hollow-extrusion-molding-cement-board curtain wall system. The construction method includes the following steps that hollow-extrusion-molding cement boards are provided, a plurality of cavities penetrating two end faces are formed inside the cement boards; connecting pieces are provided, and are fixed on the cement boards; a keel skeleton is constructed on a building external wall; supporting boards are installed on the keel skeleton; the cement boards are arranged on the supporting boards, the connecting pieces are fixedly connected with the keel skeleton, the cement boards are hung on the outer side of the building external wall accordingly, and construction of the cement-board curtain wall system is completed. According to the construction method, the construction, enclosure, and installment integrated cement board curtain wall system is formed through hollow extrusion molding. An existing stone curtain wall can be replaced with the curtain wall system, and the problems of the stone curtain wall are solved.

C. A Chinese patent, CN204738673U was issued in 2015 for a Board window. The utility model discloses a board window that wafts on to the current residential building and adapts to the cement plate to make attachment. This kind of production method has a production cycle that is much too long, a manufacturing cost that is high, and a big technical problem of intensity of labor. Technical scheme is a follows: a board window that wafts to the wall and roof, a window bottom plate and two side stands waft, the window roof that wafts all sets up on the structure wall body with the window bottom plate that wafts between the window bottom plate for the height of the window with two stands to support the window roof between the window bottom plate and window top rail at a roof D. A Japanese patent, JP2007092409A by Takahashi issued in 2010 for a Sash Window. PROBLEM TO BE SOLVED: To provide a sash window superior in workability and appearance design, and capable of securing sufficient cut-off performance. SOLUTION: A cement board of an outside surface part in an outer wall finishing material can abut on the tip of a projection piece part of a vertical support frame, and since the cement board of a bending part is fixed to the projection piece part by fastening of a machine screw, the cement board is positioned by the projection piece part, and the workability can be improved by facilitating installation in construction. Positional dislocation of the bending part 3B and a window frame body can be prevented, and the appearance design of an outer wall and a double sliding window can be improved. The water cut-off performance can also be improved by lengthening a distance up to a water cut-off position from a fixing piece part from an outdoor space by connecting the indoor side edge of the bending part to a face piece part.

E. A U.S. Pat. No. 8,950,156 by Vandehey was issued in 2015 entitled A method for modifying walls. In some embodiments, a form assembly is provided with a form member facing an existing wall, to which sheathing panels are attached. The cavity created between the sheathing panels and the existing wall can be filled with a foam able, adhesive material which adheres to the sheathing panels and the existing wall and creates an adhesive connection between them. In some embodiments, the form assembly is vertically adjustable to facilitate the installation of multiple rows of sheathing panels. In some embodiments, the foam able, adhesive material is introduced in successive layers.

F. A European publication EP2060725B1 was authored by Hain in 2011 and entitled A frame for the insertion of a door or window. Here, the invention relates to a frame for mounting a window or a door in a building wall, consisting of four connected at their ends to form a frame spar.

As can be observed, none of the prior art has anticipated or caused one skilled in the art of window devices to see this invention by Cindy Schleich as obvious to a person skilled in the ordinary art of the industry of making windows, the window device with a cementitious board as a frame material for the exterior surface provides an answer to a window with a more durable, paintable surface at lower initial and upkeep costs. The invention is providing a superior window for commercial and residential building structures.

SUMMARY OF THE INVENTION

This invention is a window device with a cement board as a frame material. The preferred embodiment is a window device with a cement board as a frame material of an exterior section, the device is comprised of: (a) an interior section (wood, aluminum, vinyl etc.) of the window device with a cement board as a frame material comprising a pair of stiles, a bottom rail, and a top rail; (b) an exterior section (cement board or equal) of the window device with a cement board as a frame material comprising a pair of stiles, a bottom rail, and a top rail; (c) a means to secure/connect such as adhesive, epoxy, exterior grade glue, fasteners, or integral molding the interior section to the exterior section; (d) Stop structures and means to connect top rails and bottom rails of the window to a sill and a header of a rough framing for commercial or residential structures, the means being such as fasteners, adhesives, stop strips, and typical mechanical hardware (clips, nails, tacks, screws, etc.); and (e) a jamb liner strip which goes on the sides of the window device that provides a snug fit for a window sash of the window device with a cement board to a pair of jambs which are secured to the rough framing for commercial or residential structures wherein the window device is used as a new and/or a replacement window in a commercial or residential structure.

The newly invented window device with a cement board (like a Hardie Weatherboard®) as a frame material can be manufactured at low volumes by very simple means and in high volume production by more complex and controlled systems.

Objects and Advantages

There are several objects and advantages of the A window device with a cement board as a frame material of the exterior surface. There are currently no known window or door devices that are effective at providing the objects of this invention. The device has various advantages and benefits:

| Item | Advantages |
|---|---|
| 1 | Is a low-cost maintenance due to the durable cementitious board |
| 2 | Is paintable |
| 3 | Can be made as pre-painted panels |
| 4 | Are moisture and rot resistant |
| 5 | Are not susceptible to pest |
| 6 | Provides a surface that is durable over time |
| 7 | Is non-combustible, and |
| 8 | Is environmentally friendly by using known materials available today with little environmental impact |

Finally, other advantages and additional features of the present window device with a cement board as a frame material of the exterior surface will be more apparent from the accompanying drawings and from the full description of the device. For one skilled in the art of window and door devices and systems, it is readily understood that the features shown in the examples with this product are readily adapted to other types of window and door systems and devices.

DESCRIPTION OF THE DRAWINGS—FIGURES

The accompanying drawings, which are incorporated in and constitute a part of this specification, illustrate an embodiment of the window device with a cement board as a frame material of the exterior surface that is preferred. The drawings together with the summary description given above and a detailed description given below explain the principles of this special window device. It is understood, however, that the window device with a cement board (like a Hardie Weatherboard®) as a frame material of the exterior surface is not limited to only the precise arrangements and instrumentalities shown.

Figures 5, 5C, 6, 6A, 6B, 6C:
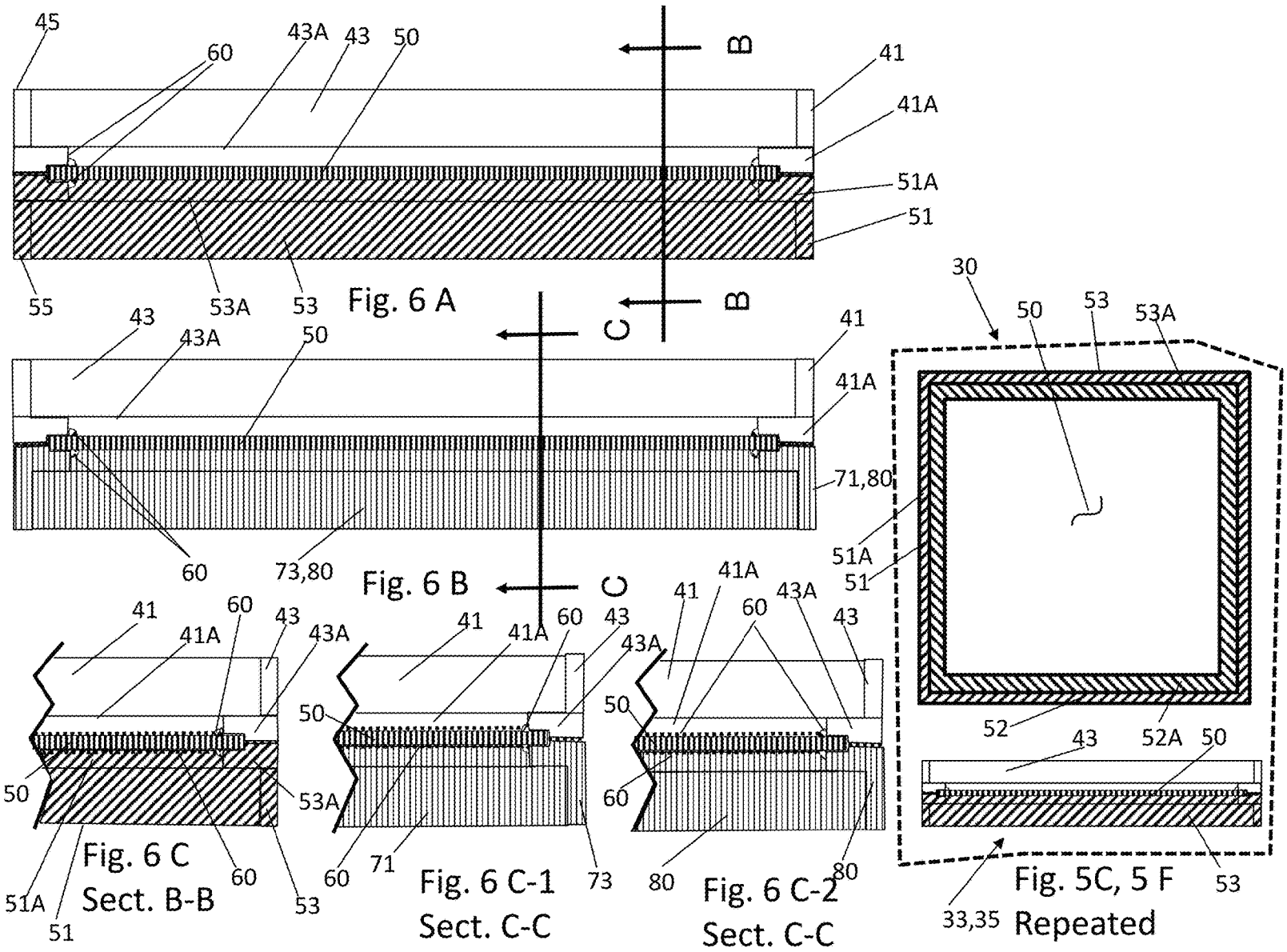

FIGS. 6A through 6C, C-1 and C-2 are drawings of the section views for the window device with a cement board as the exterior surface of the frame material with features noted.

FIG. 7A through 7E are sketches of various uses for the window device with a cement board as the exterior surface of the frame material.

Figure 8B:
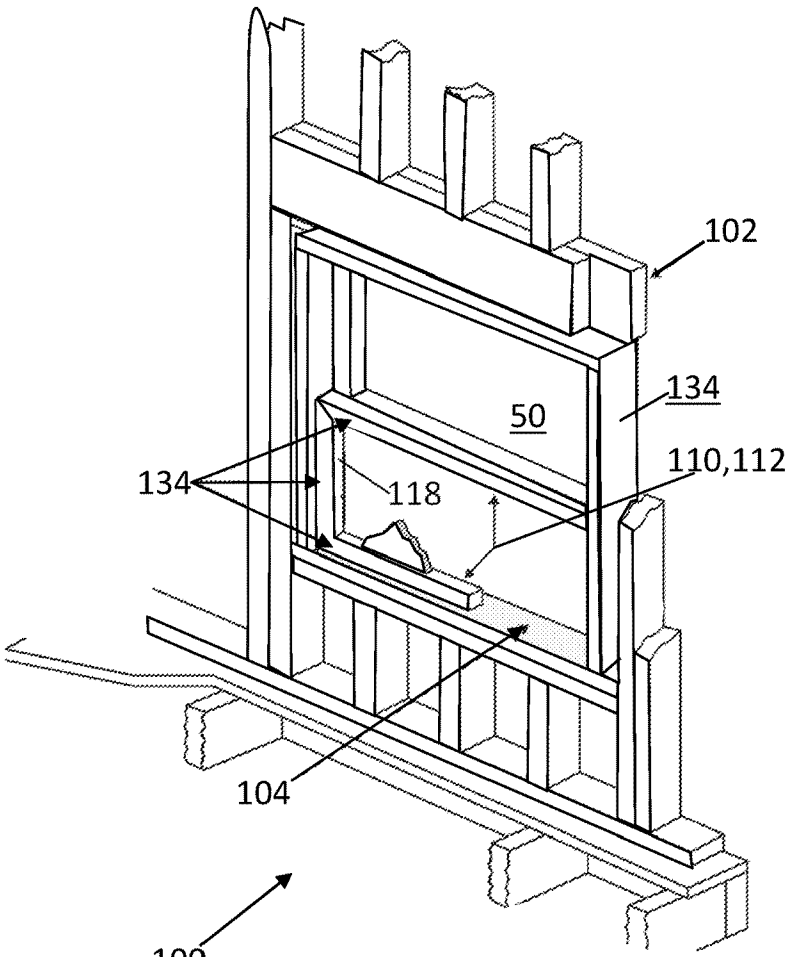
Fig. 8 B Prior Art
Figure 8A:
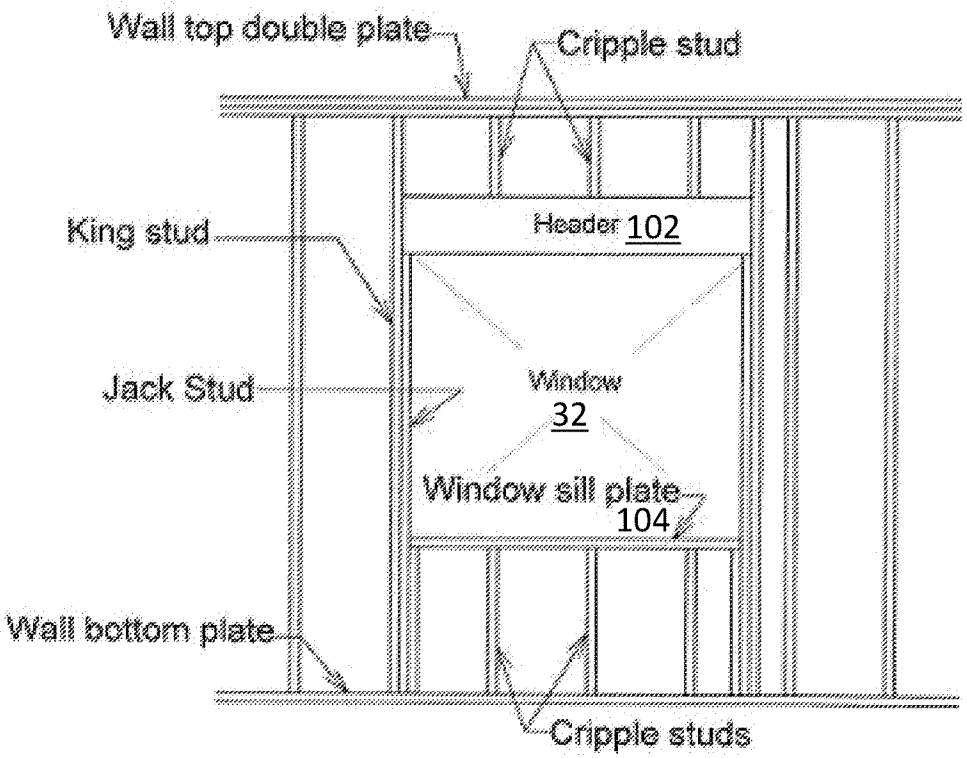
Fig. 8 A Prior Art
Figure 10B:
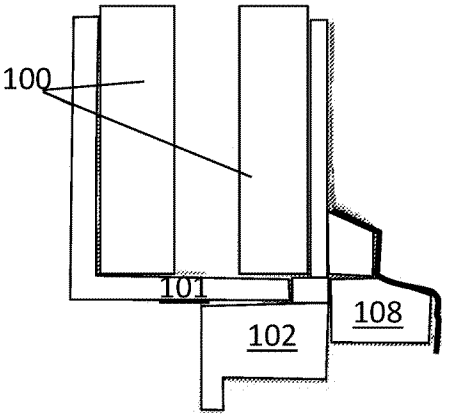
Figure 10D:
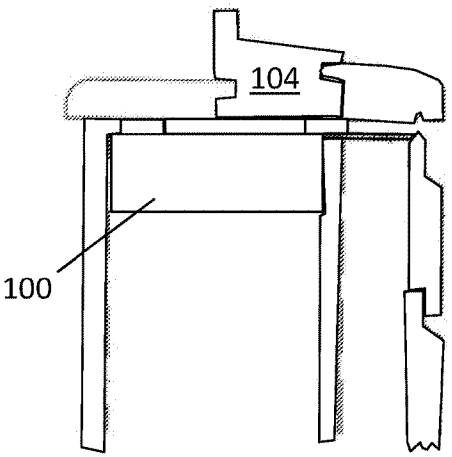
Figure 10A:
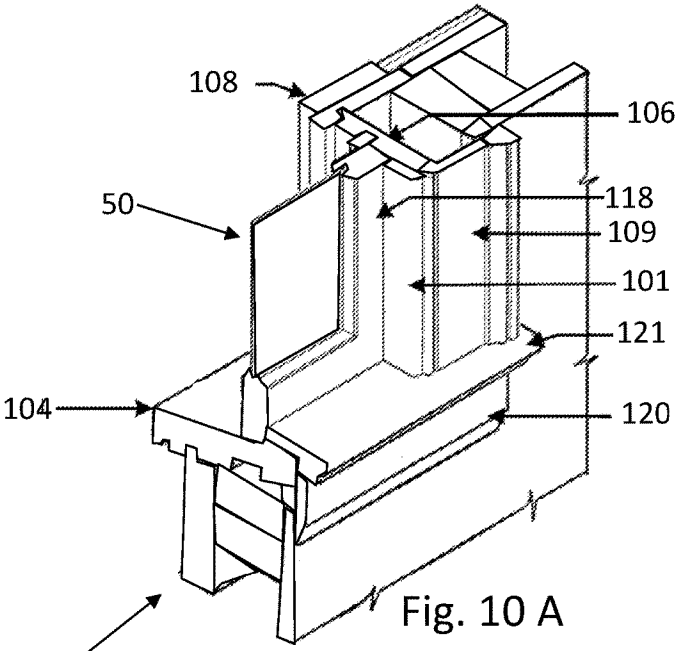
Figure 10C:
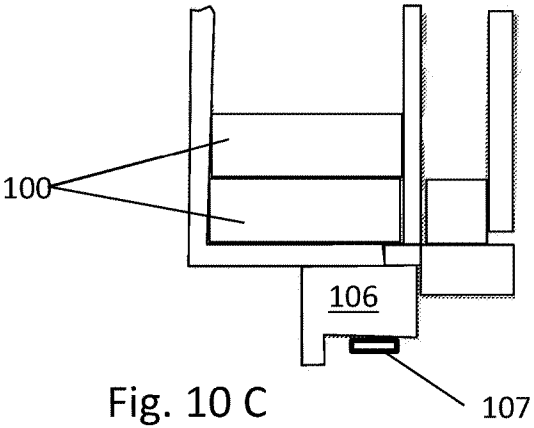

FIGS. 8A and 8B are sketches of prior art showing the rough framing of a commercial or residential structure for a typical window.

FIG. 9A through 9C are sketches of prior art showing more details of a typical window.

FIG. 10A through 10D are additional sketches of prior art typical windows with components and features.

DESCRIPTION OF THE DRAWINGS—REFERENCE NUMERALS

The following list refers to the drawings:

TABLE B

| Reference numbers | |
|---|---|
| Ref # | Description |
| 30 | a window device 30 with a cement board as a frame material |
| 31 | a prototype 31 of a window device 30 with a cement board as a frame material |
| 32 | a typical window 32 - wood, vinyl, aluminum, plastic, composite material, etc. as a stationary, single hung, double hung, side by side, pivot or tilt, etc. |
| 33 | an interior section 33 (wood, aluminum, vinyl, plastic, composite material etc.) of the window device 30 with a cement board as a frame material |
| 35 | an exterior section 35 (cement board or equal) of the window device 30 with a cement board (like a Hardie Weatherboard RTM or the like) as a frame material |
| 36 | a side view 36 of a complete window device 30 with a cement board as a frame material |
| 37 | a side view 37 of an interior section 33 (wood or equal) of a window device 30 with a cement board as a frame material |
| 38 | a side view 38 of an exterior section 35 (cement board or equal) of a window device 30 with a cement board as a frame material |

TABLE B-continued

| Reference numbers | |
|---|---|
| Ref # | Description |
| 39 | a corner view 39 of a window device 30 with a cement board as a frame material |
| 40 | a means 40 to secure/connect such as adhesive, epoxy, exterior grade glue, fasteners, or integral molding or forming an Interior section 33 (wood, aluminum, vinyl, plastic, composite material etc.) of the window device 30 with a cement board as a frame material to an Exterior section 35 (cement board or equal) of the window device 30 with a cement board (like a Hardie Weatherboard RTM) as a frame material |
| 40A | A means 40A to movably (slide, pivot) secure/connect the window device 30 to the header 102, sill 104, or jamb 106 such as stop plates, pivot hardware, or the like |
| 41 | a stile 41 of Interior section 33 (wood, aluminum, vinyl etc.) of the window device 30 with a cement board as a frame material |
| 41A | a portion or board 41A of stile 41 that is contiguous to a window, pane 50 |
| 42 | a bottom rail 42 of Interior section 33 (wood, aluminum, vinyl etc.) of the window device 30 with a cement board as a frame material |
| 42A | a portion or board 42A of bottom rail 42 that is contiguous to a window, pane 50 |
| 43 | a top rail 43 of interior section 33 (wood, aluminum, vinyl etc.) of the window device 30 with a cement board as a frame material |
| 43A | a portion or board 43A of top rail 43 that is contiguous to a window, pane 50 |
| 45 | a corner 45 of interior section 33 (wood, aluminum, vinyl etc.) of the window device 30 with a cement board as a frame material |
| 50 | a window, glass, pane, lite 50 can be single, double, triple with sealant 130 and inert gas 132, can be traditional, tempered or bullet proof |
| 51 | a stile 51 of exterior section 35 (cement board or equal) of the window device 30 with a cement board as a frame material |
| 51A | a portion or board 51A of stile 51 that is contiguous to a window, pane 50 |
| 52 | a bottom rail 52 of exterior section 35 (cement board or equal) of the window device 30 with a cement board as a frame material |
| 52A | a portion or board 52A of bottom rail 52 that is contiguous to a window, pane 50 |
| 53 | a top rail 53 of exterior section 35 (cement board or equal) of the window device 30 with a cement board as a frame material |
| 53A | a portion or board 53A of top rail 53 that is contiguous to a window, pane 50 |
| 55 | a corner 55 of exterior section 35 (cement board or equal) of the window device 30 with a cement board as a frame material |
| 60 | a glazing/caulk/sealant 60 at joint between glass 50 and either wood or cement board components 33, 36 of the window device 30 with a cement board as a frame material |
| 70 | a molded, discrete section 70 of exterior section 35 (cement board or equal) of the window device 30 with a cement board (like a Hardie Weatherboard RTM) as a frame material |
| 71 | a molded, discrete stile 71 of exterior section 35 (cement board or equal) of the window device 30 with a cement board as a frame material |
| 72 | a molded, discrete bottom rail 72 of exterior section 35 (cement board or equal) of the window device 30 with a cement board as a frame material |
| 73 | a molded, discrete top rail 73 of exterior section 35 (cement board or equal) of the window device 30 with a cement board as a frame material |

TABLE B-continued

| Reference numbers | |
|---|---|
| Ref # | Description |
| 80 | a one piece, integrally molded cement portion 80 (pair of stiles, top rail, and bottom rail) of the exterior (cement board or equal) of the window device 30 with a cement board as a frame material |
| 90 | a single stationary 90 window frame of a window device 30 with a cement board as a frame material, an inoperable panel of a window |
| 93 | a double hung 93 window frame of a window device 30 with a cement board as a frame material |
| 95 | a tilt out/swing 95 window frame of a window device 30 with a cement board as a frame material |
| 98 | a side-by-side 97 window frame of a window device 30 with a cement board as a frame material |
| 100 | a rough framing 100 for commercial or residential structures |
| 101 | Stop structures and means 101 to connect sills 104 and headers 102 to window 30 at top rails 43, 53 and bottom rails 42, 52 - fasteners, adhesives, stop strips, and typical mechanical hardware (clips, nails, tacks, screws, etc.); |
| 102 | a header 102 - main horizontal part forming the top of the window frame |
| 104 | a sill plate 104 - main horizontal part forming the bottom horizontal part of the frame 30 of a window, a piece that runs along the base of the window frame 30 |
| 106 | a jamb 106 - main vertical parts forming the sides of a window frame |
| 107 | a jamb liner 107 - strip which goes on the sides of a window frame that provides a snug fit for the window sash |
| 108 | an exterior casing 108 - decorative molding or framing around a window 30 on the exterior to cover the space between the window frame or jamb 106 and the wall |
| 109 | an interior casing 109 - decorative molding or framing around a window 30 on the interior to cover the space between the window frame or jamb 106 and the wall |
| 110 | a top rail 110 - upper horizontal piece of a window sash |
| 112 | a bottom rail 112 - lower horizontal piece of a window sash |
| 114 | a pull 114 - handle for raising the lower sash 134 in a single- or double-hung window 30 |
| 116 | a lock 116 - locking mechanism used on a single- or double-hung window 30 that engages with the sash 134 to reduce rattling |
| 118 | a stile 118 - the vertical part of a sash 134 |
| 120 | an apron 120 - piece attached to the wall beneath the sill 104 |
| 121 | a stool 121 - visible piece of wood, metal or stone attached to the sill 104 on which one might sit plants or other items |
| 122 | a muntin 122 - actual bars that create a pattern in the window glass 50 |
| 130 | a sealant between thermo windows (double, triple, etc.) panes 50 |
| 132 | an inert, nontoxic gas 132 such as argon used in insulating glass units to reduce heat transfer |
| 134 | a sash 134 - movable part of the window 30, the framework 134 that, holds the glass 50 in place |
| 136 | a weather strip 136 - strip of resilient material for covering the joint between the window sash 134 and frame 30 to reduce air leaks and prevent water from entering the structure |

TABLE B-continued

| Reference numbers | |
|---|---|
| Ref # | Description |
| 138 | a mullion 138 - major structural vertical or horizontal piece that combines two or more windows 30 together |
| 140 | a series of siding panels 140 |

DETAILED DESCRIPTION OF PREFERRED EMBODIMENT

The present development is a window device with a cement board as a frame material of the exterior surface. The present invention relates to the field of windows. In particular, the present invention relates to a single or double window apparatus with an exterior configured with a cementitious board or structure such as that commonly known as "Hardie Weatherboard®" [RTM—Registered Trademark]. This device is a novel rectangular frame for providing stationary and movable windows with a superior exterior. The new device provides more value with less initial cost and lower maintenance expenses. These new devices provide a paintable and maintenance friendly window. The present invention relates generally to window frames for buildings of all types, and more particularly to such frames as are easily formed and readily adaptable to substantially any size or shape opening. It relates to the field of prefabricated window panels, and more specifically to prefabricated panels having an exterior of a cementitious material. The applications anticipate original equipment and aftermarket uses described and discussed below.

The advantages for the window device 30 with a cement board as a frame material of the exterior surface are listed above in the introduction. Succinctly the benefits are that the device:

A. Is a low-cost maintenance due to the durable cementitious board;
B. Is paintable;
C. Can be made as pre-painted panels;
D. Are moisture and rot resistant;
E. Are not susceptible to pest;
F. Provides a surface that is durable over time;
G. Is non-combustible; and
H. Is environmentally friendly by using known materials available today with little environmental impact.

The preferred embodiment is a window device with a cement board as a frame material of an exterior section, the device is comprised of: (a) an interior section 33 (wood, aluminum, vinyl, plastic, composite material etc.) of the window device 30 with a cement board as a frame material comprising a pair of stiles 41, a bottom rail 42, and a top rail 43; (b) an exterior section 35 (cement board or equal) of the window device 30 with a cement board as a frame material comprising a pair of stiles 51, a bottom rail 52, and a top rail 53; (c) a means 40 to secure/connect such as adhesive, epoxy, exterior grade glue, fasteners, or integral molding the interior section 33 to the exterior section 35; (d) Stop structures and means 101 to connect top rails 43,53 and bottom rails 42,52 of the window 30 to a sill 104 and a header 102 of a rough framing 100 for commercial or residential structures, the means being such as fasteners, adhesives, stop strips, and typical mechanical hardware (clips, nails, tacks, screws, etc.); and (e) a jamb liner 107 strip which goes on the sides of the window 30 device that provides a snug fit for a window sash 134 of the window device 30 with a cement board to a pair of jambs 106 which are secured to the rough framing 100 for commercial or residential structures wherein the window device 30 is used as a new and/or a replacement window in a commercial or residential structure.

There is shown in FIGS. 1-10 a complete description and operative embodiment of the window device 30 with a cement board as a frame material of the exterior surface. In the drawings and illustrations, one notes well that the FIGS. 1-10 demonstrate the general configuration and use of this product. The various example uses are in the operation and use section, below.

The accompanying drawings, which are incorporated in and constitute a part of this specification, illustrate an embodiment of the window device 30 with a cement board as a frame material of the exterior surface that is preferred. The drawings together with the summary description given above and a detailed description given below explain the principles of the special window device 30. It is understood, however, that the window device 30 is not limited to only the precise arrangements and instrumentalities shown. Other examples of window and door devices and uses are still understood by one skilled in the art of this industry to be within the scope and spirit shown here.

Figure 1B:
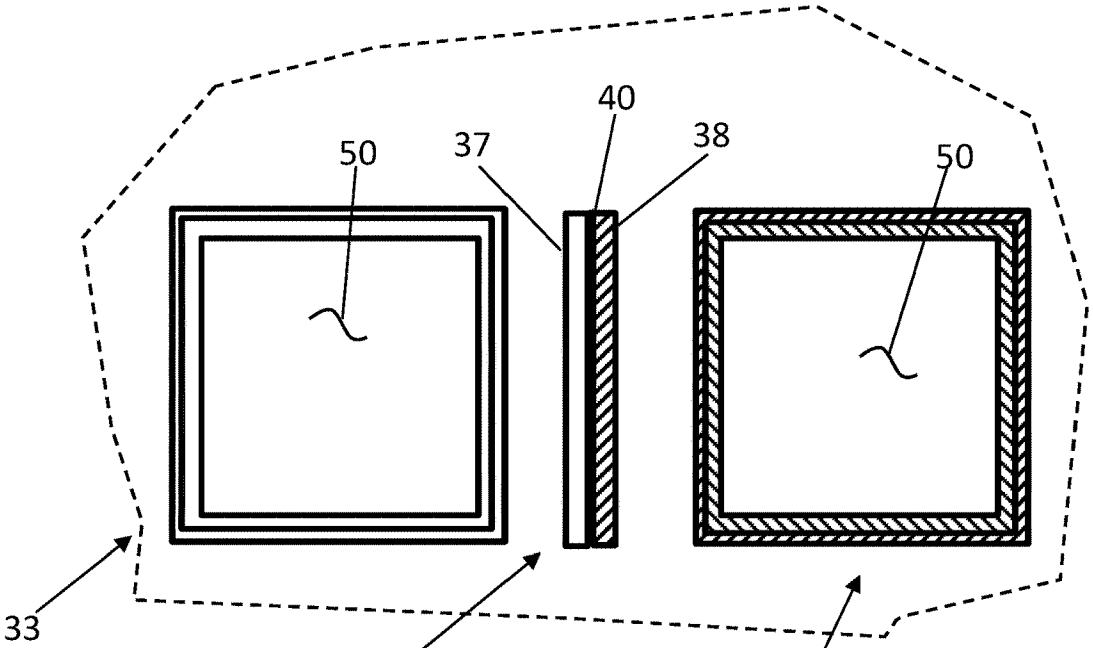
FIGS. 1A through 1C are sketches of a general window device with a cement board the exterior surface of the frame material.
Figure 1C:
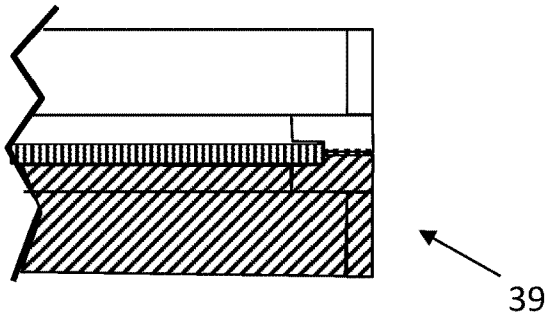
Figure 1A:
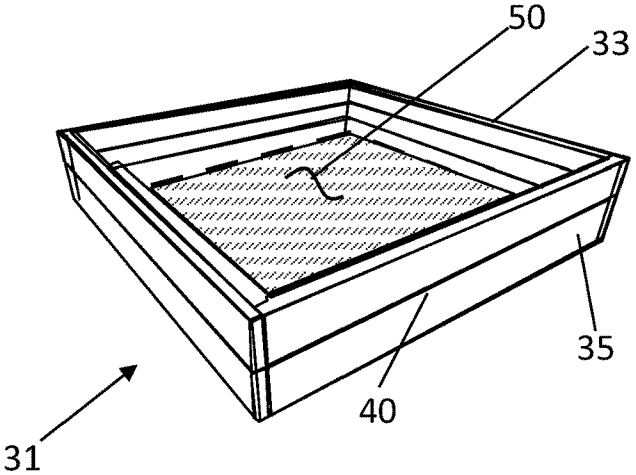

FIGS. 1A through 1C are sketches of a general window device 30 with a cement board as the exterior surface of the frame material. Depicted in these sketches are: a window device 30 with a cement board as a frame material; a prototype 31 of a window device 30 with a cement board as a frame material; an interior section 33 (wood, aluminum, vinyl etc.) of the window device 30 with a cement board as a frame material; an exterior section 35 (cement board or equal) of the window device 30 with a cement board as a frame material; a side view 36 of a complete window device 30 with a cement board as a frame material; a side view 37 of an interior section 33 (wood or equal) of a window device 30 with a cement board as a frame material; a side view 38 of an exterior section 35 (cement board or equal) of a window device 30 with a cement board as a frame material; a corner view 39 of a window device 30 with a cement board as a frame material; a means 40 to secure/connect such as adhesive, epoxy, exterior grade glue, fasteners, or integral molding or forming an Interior section 33 (wood, aluminum, vinyl, plastic, composite material etc.) of the window device 30 with a cement board as a frame material to an Exterior section 35 (cement board or equal) of the window device 30 with a cement board as a frame material; and a window, glass, pane, lite 50 can be single, double, triple with sealant 130 and inert gas 132, can be traditional, tempered or bullet proof.

Figure 2B:
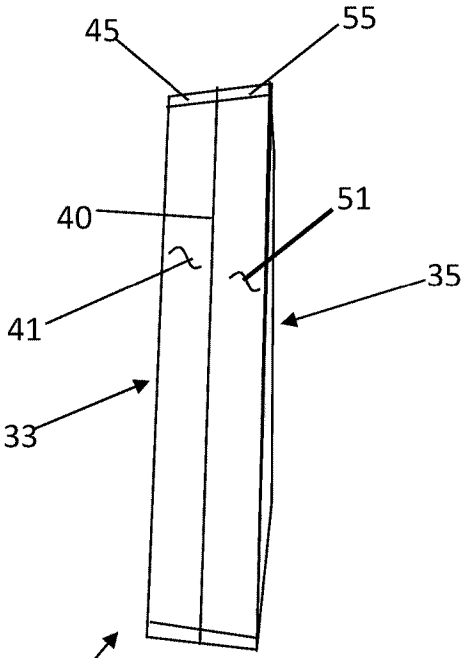
FIGS. 2A through 2C are sketches of a prototype of the window device with a cement board as the exterior surface of the frame material with components and features noted.
Figure 2A:
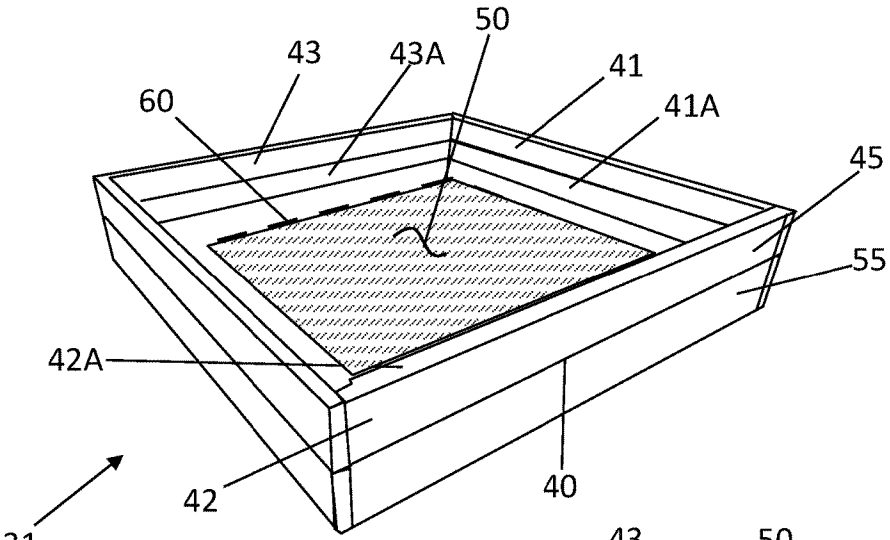
Figure 2C:
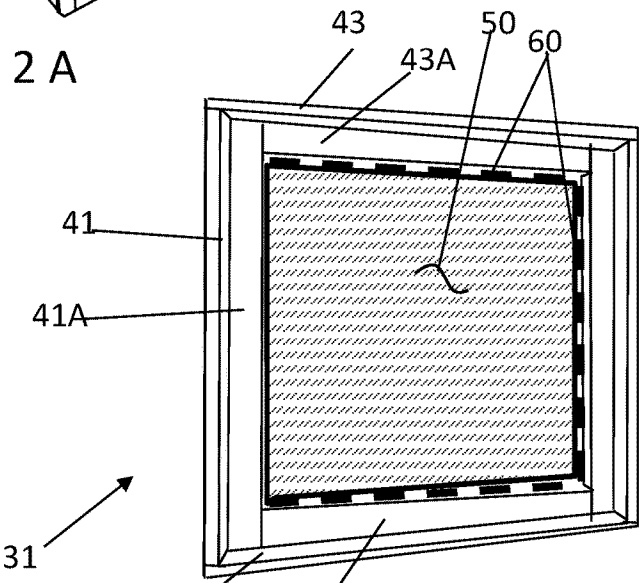
Figure 3D:
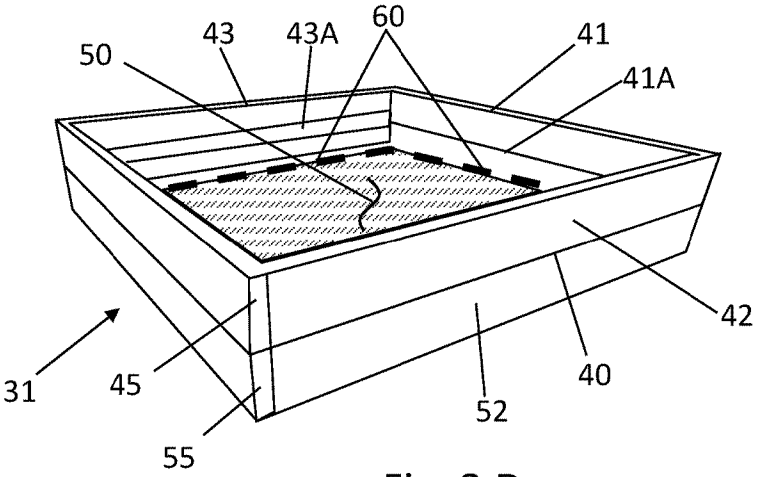
FIGS. 3A through 3D are additional sketches of the prototype of the window device with a cement board as the exterior surface of the frame material with components and features noted.
Figure 3B:
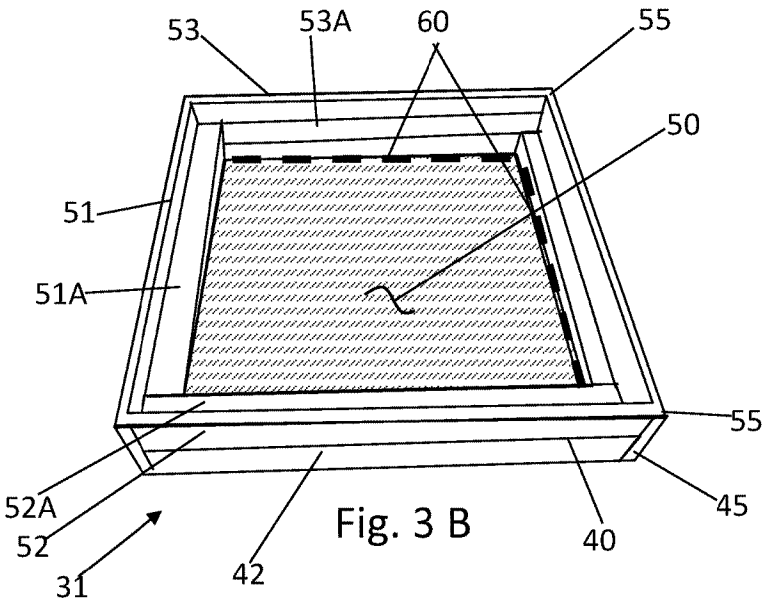
Figure 3C:
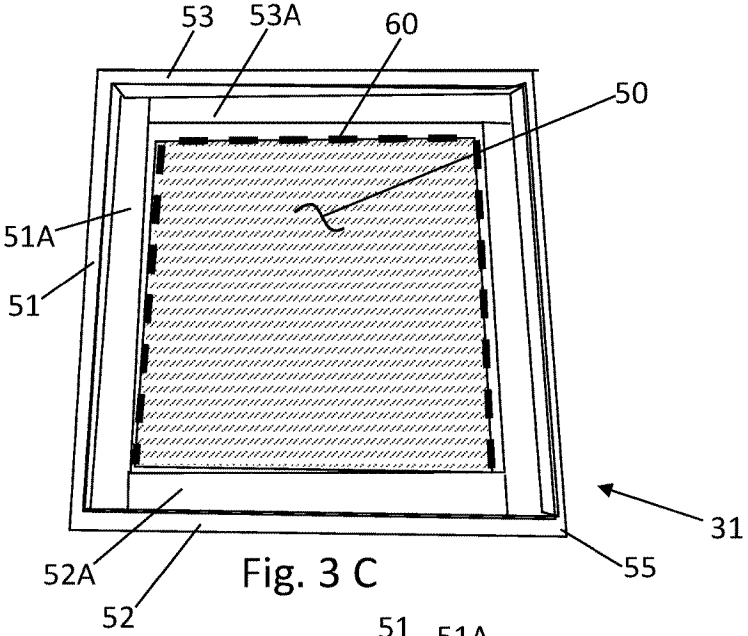
Figure 3A:
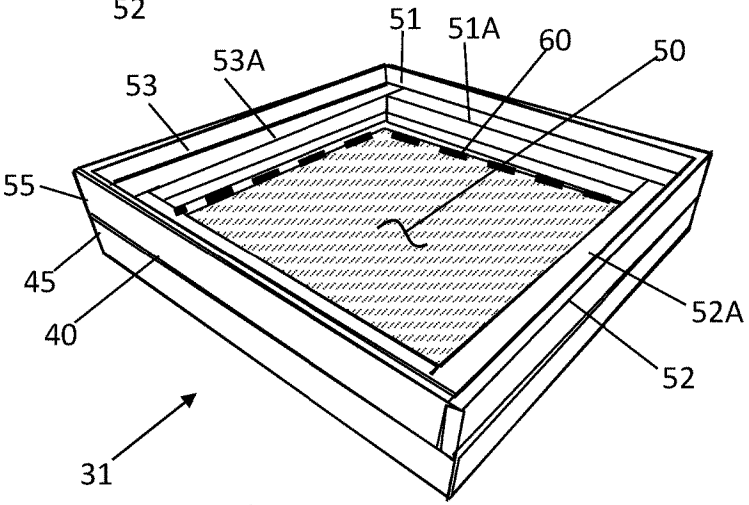
Figure 4D:
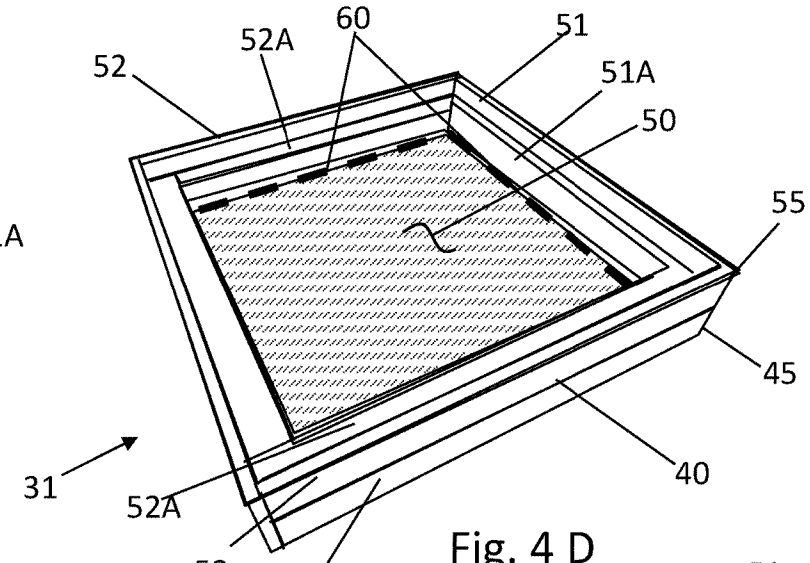
FIGS. 4A through 4D are sketches of sections of the prototype of the window device with a cement board as the exterior surface of the frame material with components and features noted.
Figure 4B:
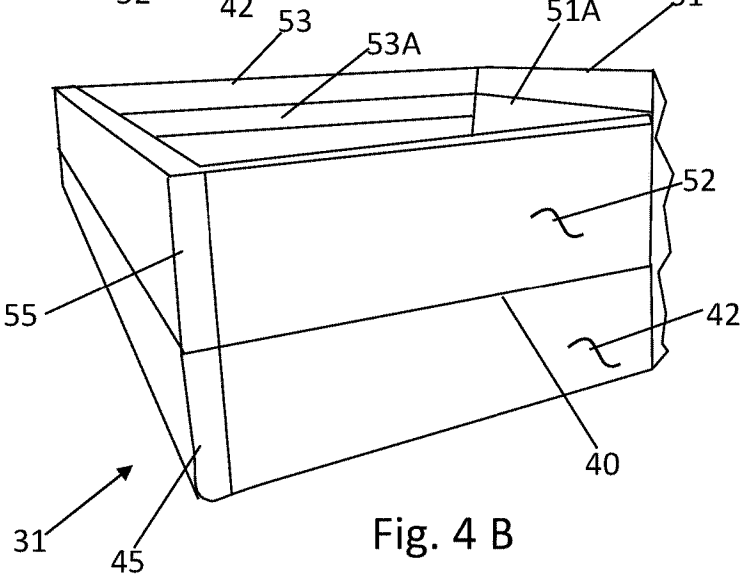
Figure 4C:
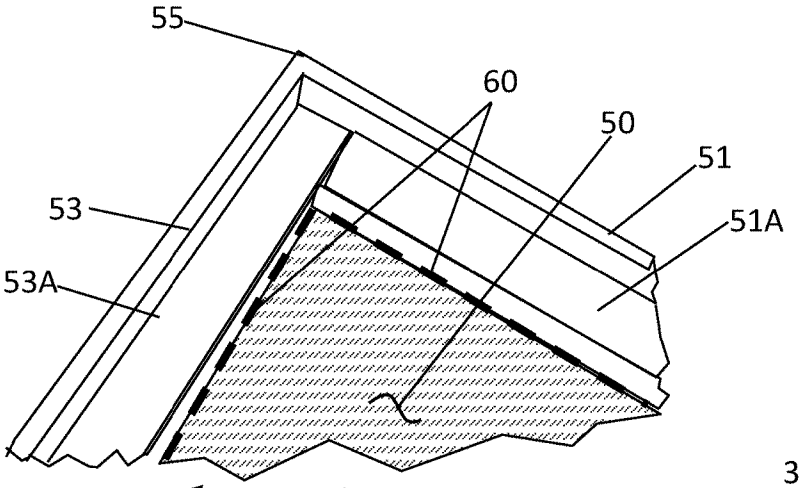
Figure 4A:
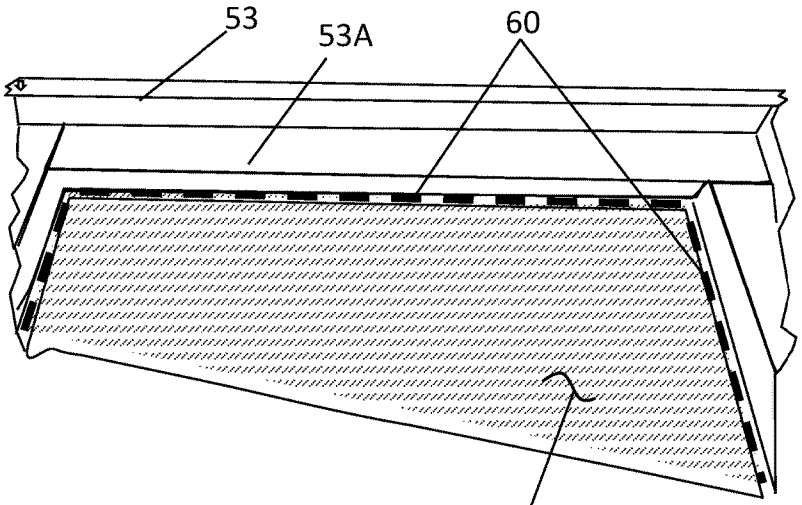
Figures 5A, 5B, 5C, 5D, 5E, 5F:
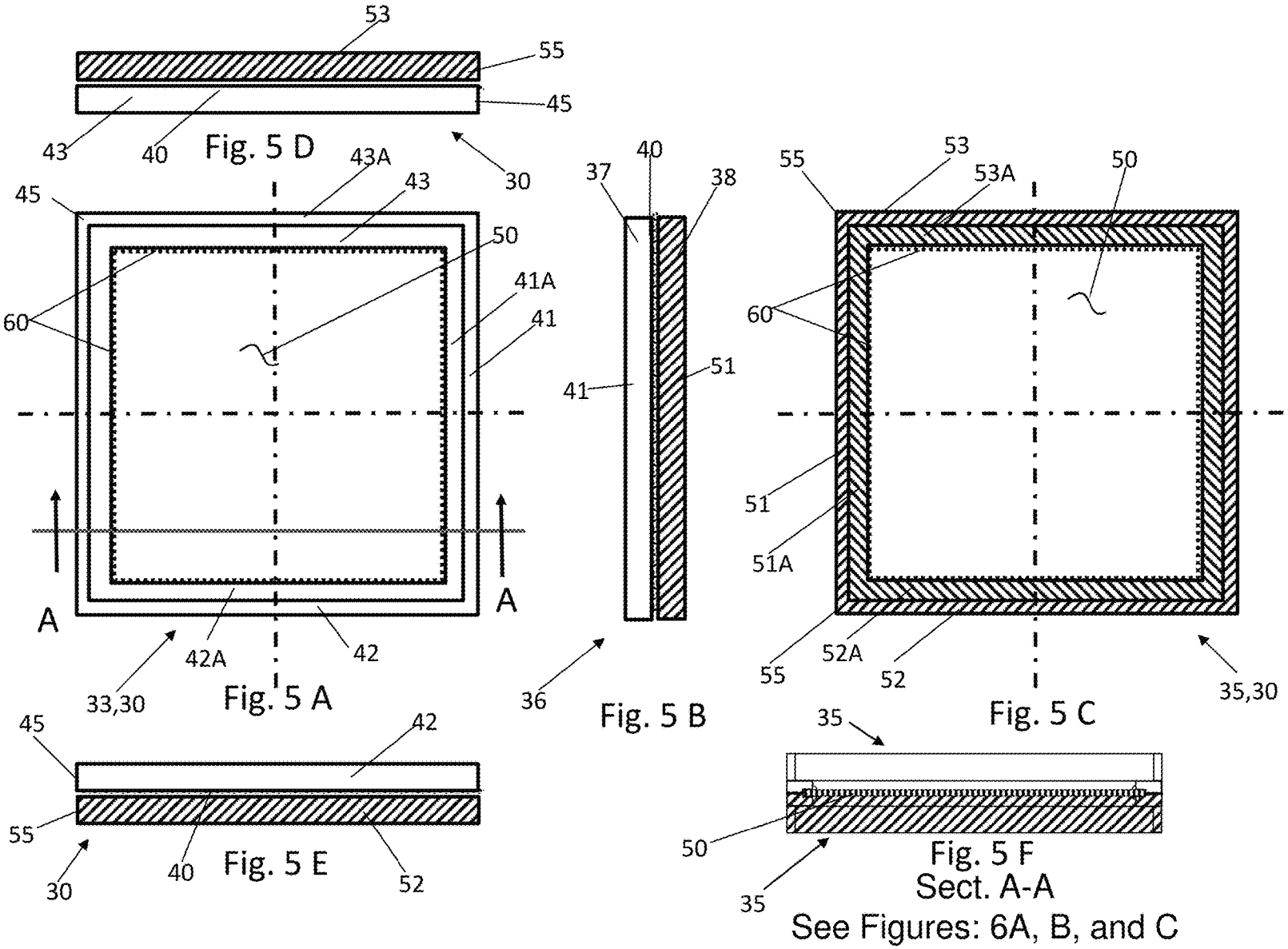
FIG. 5A through 5F are drawings of the window device with a cement board as the exterior surface of the frame material with features noted.

FIGS. 2A through 2C are sketches of a prototype 31 of the window device 30 with a cement board as the exterior surface of the frame material with components and features noted. Provided in these drawings are: a prototype 31 of a window device 30 with a cement board as a frame material; an interior section 33 (wood, aluminum, vinyl, plastic, composite material etc.) of the window device 30 with a cement board as a frame material; a means 40 to secure/connect such as adhesive, epoxy, exterior grade glue, fasteners, or integral molding an Interior section 33 (wood, aluminum, vinyl etc.) of the window device 30 with a cement board as a frame material to an Exterior section 35 (cement board or equal) of the window device 30 with a cement board as a frame material; a stile 41 of Interior section 33 (wood, aluminum, vinyl, plastic, composite material etc.) of the window device 30 with a cement board as a frame material; a portion or board 41A of stile 41 that is contiguous to a window, pane 50; a bottom rail 42 of Interior section 33 (wood, aluminum, vinyl etc.) of the window device 30 with a cement board as a frame material; a portion or board 42A of bottom rail 42 that is contiguous to a window, pane 50; a top rail 43 of interior section 33 (wood, aluminum, vinyl etc.) of the window device 30 with a cement board as a frame material; a portion or board 43A of top rail 43 that is contiguous to a window, pane 50; a corner 45 of interior section 33 (wood, aluminum, vinyl etc.) of the window device 30 with a cement board as a frame material; a window, glass, pane, lite 50 can be single, double, triple with sealant 130 and inert gas 132, can be traditional, tempered or bullet proof; a stile 51 of exterior section 35 (cement board or equal) of the window device 30 with a cement board (similar to a Hardie Weatherboard®) as a frame material; a corner 55 of exterior section 35 (cement board or equal) of the window device 30 with a cement board as a frame material; and a glazing/caulk/sealant 60 at joint between glass 50 and either wood or cement board components 33,36 of the window device 30 with a cement board as a frame material.

FIGS. 3A through 3D are additional sketches of the prototype 31 of the window device 30 with a cement board as the exterior surface of the frame material with components and features noted. These prototype drawings display: a prototype 31 of a window device 30 with a cement board as a frame material; and a means 40 to secure/connect such as adhesive, epoxy, exterior grade glue, fasteners, or integral molding an Interior section 33 (wood, aluminum, vinyl etc.) of the window device 30 with a cement board as a frame material to an Exterior section 35 (cement board or equal) of the window device 30 with a cement board as a frame material. Also included are: a stile 41 of Interior section 33 (wood, aluminum, vinyl, plastic, composite material etc.) of the window device 30 with a cement board as a frame material; a portion or board 41A of stile 41 that is contiguous to a window, pane 50; a bottom rail 42 of Interior section 33 (wood, aluminum, vinyl, plastic, composite material etc.) of the window device 30 with a cement board as a frame material; a portion or board 42A of bottom rail 42 that is contiguous to a window, pane 50; a top rail 43 of interior section 33 (wood, aluminum, vinyl, plastic, composite material etc.) of the window device 30 with a cement board as a frame material; a portion or board 43A of top rail 43 that is contiguous to a window, pane 50; a corner 45 of interior section 33 (wood, aluminum, vinyl etc.) of the window device 30 with a cement board as a frame material; and a window, glass, pane, lite 50 can be single, double, triple with sealant 130 and inert gas 132, can be traditional, tempered or bullet proof. Added features are: a stile 51 of exterior section 35 (cement board or equal) of the window device 30 with a cement board as a frame material; a portion or board 51A of stile 51 that is contiguous to a window, pane 50; a bottom rail 52 of exterior section 35 (cement board or equal) of the window device 30 with a cement board as a frame material; a portion or board 52A of bottom rail 52 that is contiguous to a window, pane 50; a top rail 53 of exterior section 35 (cement board or equal) of the window device 30 with a cement board as a frame material; a portion or board 53A of top rail 53 that is contiguous to a window, pane 50; a corner 55 of exterior section 35 (cement board or equal) of the window device 30 with a cement board as a frame material; and a glazing/caulk/sealant 60 at joint between glass 50 and either wood or cement board components 33,36 of the window device 30 with a cement board as a frame material.

FIGS. 4A through 4D are sketches of sections of the prototype 31 of the window device 30 with a cement board as the exterior surface of the frame material with components and features noted. These are section views that again show and demonstrate: a prototype 31 of a window device 30 with a cement board as a frame material; a means 40 to secure/Non-Provisional connect such as adhesive, epoxy, exterior grade glue, fasteners, or integral molding an Interior section 33 (wood, aluminum, vinyl etc.) of the window device 30 with a cement board as a frame material to an Exterior section 35 (cement board or equal) of the window device 30 with a cement board as a frame material; a stile 41 of Interior section 33 (wood, aluminum, vinyl etc.) of the window device 30 with a cement board as a frame material; a portion or board 41A of stile 41 that is contiguous to a window, pane 50; a bottom rail 42 of Interior section 33 (wood, aluminum, vinyl etc.) of the window device 30 with a cement board as a frame material; a portion or board 42A of bottom rail 42 that is contiguous to a window, pane 50; a top rail 43 of interior section 33 (wood, aluminum, vinyl etc.) of the window device 30 with a cement board as a frame material; a portion or board 43A of top rail 43 that is contiguous to a window, pane 50; and a corner 45 of interior section 33 (wood, aluminum, vinyl etc.) of the window device 30 with a cement board as a frame material. Shown also is a window, glass, pane, lite 50 can be single, double, triple with sealant 130 and inert gas 132, can be traditional, tempered or bullet proof; a stile 51 of exterior section 35 (cement board or equal) of the window device 30 with a cement board as a frame material. These drawings feature: a portion or board 51A of stile 51 that is contiguous to a window, pane 50; a bottom rail 52 of exterior section 35 (cement board or equal) of the window device 30 with a cement board (similar to a Hardie Weatherboard® or the like) as a frame material; a portion or board 52A of bottom rail 52 that is contiguous to a window, pane 50; a top rail 53 of exterior section 35 (cement board or equal) of the window device 30 with a cement board as a frame material; a portion or board 53A of top rail 53 that is contiguous to a window, pane 50; a corner 55 of exterior section 35 (cement board or equal) of the window device 30 with a cement board as a frame material; and a glazing/caulk/sealant 60 at joint between glass 50 and either wood or cement board components 33,36 of the window device 30 with a cement board as a frame material.

FIG. 5A through 5F are drawings of the window device 30 with a cement board as the exterior surface of the frame material with features noted. Demonstrated here is the window device 30 with a cement board as a frame material. The means 40 to secure/connect such as adhesive, epoxy, exterior grade glue, fasteners, or integral molding an Interior section 33 (wood, aluminum, vinyl etc.) of the window device 30 with a cement board as a frame material to an Exterior section 35 (cement board or equal) of the window device 30 with a cement board as a frame material. Features shown are a stile 41 of Interior section 33 (wood, aluminum, vinyl etc.) of the window device 30 with a cement board as a frame material; a portion or board 41A of stile 41 that is contiguous to a window, pane 50; a bottom rail 42 of Interior section 33 (wood, aluminum, vinyl etc.) of the window device 30 with a cement board as a frame material; a portion or board 42A of bottom rail 42 that is contiguous to a window, pane 50; a top rail 43 of interior section 33 (wood, aluminum, vinyl etc.) of the window device 30 with a cement board as a frame material; a portion or board 43A of top rail 43 that is contiguous to a window, pane 50; a corner 45 of interior section 33 (wood, aluminum, vinyl etc.) of the window device 30 with a cement board as a frame material. Additionally, shown is a window, glass, pane, lite 50 can be single, double, triple with sealant 130 and inert gas 132, can be traditional, tempered or bullet proof. Other features are: a stile 51 of exterior section 35 (cement board or equal) of the window device 30 with a cement board as a frame material; a portion or board 51A of stile 51 that is contiguous to a window, pane 50; a bottom rail 52 of exterior section 35 (cement board or equal) of the window device 30 with a cement board as a frame material; a portion or board 52A of bottom rail 52 that is contiguous to a window, pane 50; a top rail 53 of exterior section 35 (cement board or equal) of the window device 30 with a cement board as a frame material; a portion or board 53A of top rail 53 that is contiguous to a window, pane 50; a corner 55 of exterior section 35 (cement board or equal) of the window device 30 with a cement board as a frame material; and the component—a glazing/caulk/sealant 60 at joint between glass 50 and either wood or cement board components 33,36 of the window device 30 with a cement board as a frame material.

FIGS. 6A through 6C, C-1 and C-2 are drawings of the section views for the window device 30 with a cement board as the exterior surface of the frame material with features noted. Demonstrate here is the window device 30 with a cement board as a frame material. Next the features shown are: a stile 41 of Interior section 33 (wood, aluminum, vinyl etc.) of the window device 30 with a cement board as a frame material; a portion or board 41A of stile 41 that is contiguous to a window, pane 50; a bottom rail 42 of Interior section 33 (wood, aluminum, vinyl etc.) of the window device 30 with a cement board as a frame material; a portion or board 42A of bottom rail 42 that is contiguous to a window, pane 50; a top rail 43 of interior section 33 (wood, aluminum, vinyl etc.) of the window device 30 with a cement board as a frame material; a portion or board 43A of top rail 43 that is contiguous to a window, pane 50; a corner 45 of interior section 33 (wood, aluminum, vinyl etc.) of the window device 30 with a cement board as a frame material. Additionally, shown are a window, glass, pane, lite 50 can be single, double, triple with sealant 130 and inert gas 132, can be traditional, tempered or bullet proof. Other features are: a stile 51 of exterior section 35 (cement board or equal) of the window device 30 with a cement board as a frame material; a portion or board 51A of stile 51 that is contiguous to a window, pane 50; a bottom rail 52 of exterior section 35 (cement board or equal) of the window device 30 with a cement board as a frame material; a portion or board 52A of bottom rail 52 that is contiguous to a window, pane 50; a top rail 53 of exterior section 35 (cement board or equal) of the window device 30 with a cement board as a frame material; a portion or board 53A of top rail 53 that is contiguous to a window, pane 50; a corner 55 of exterior section 35 (cement board or equal) of the window device 30 with a cement board as a frame material; and the component—a glazing/caulk/sealant 60 at joint between glass 50 and either wood or cement board components 33,36 of the window device 30 with a cement board as a frame material. In all the cross-section views—Section BB FIG. 6C, and Sections CC FIGS. 6C-1 and 6C-2 are shown the wood pieces pair of stiles 41, 41A; bottom rail 42,42A; top rail 43,43A; and corners 45. However, for the cementitious material sections, there are variances. One notes that Hardie Weatherboard® is fiber cement siding manufactured by James Hardie Building Products, one of the first successful manufacturers of this material. . . . Pulverized sand, cement, and wood pulp are mixed with water to make a slurry, which is rolled out and pressed together into sheets. Therefore, the cementitious components can be separate pieces such as in Section B-B FIG. 6C. Here are shown the cementitious components as: stiles 51, 51A; bottom rail 52,52A; top rail 53,53A; and corners 55. As parts molded, the pieces are shown for section CC in FIG. 6C-1 as: molded stiles 71; bottom rail 72; and top rail 73. The are secured and connected with a means 40 to secure/connect such as adhesive, epoxy, exterior grade glue, or fasteners the cement board as a frame material of an Exterior section 35 (cement board or equal) of the window device 30. Finally, a single part integrally molded or formed/compressed as the single piece 80 as shown for section CC in FIG. 6C-2.

FIG. 7A through 7E are sketches of various uses for the window device 30 with a cement board as the exterior surface of the frame material. These are explained in the below presented Operations Section.

FIGS. 8A and 8B are sketches of prior art showing the rough framing 100 of a commercial or residential structure for a typical window. Here are shown: a typical window 32—wood, vinyl, aluminum, etc. as a stationary, single hung, double hung, side by side, pivot or tilt, etc. and a window, glass, pane, lite 50 can be single, double, triple with sealant 130 and inert gas 132, can be traditional, tempered or bullet proof. Next are shown typical components: a rough framing 100 for commercial or residential structures; a header 102—main horizontal part forming the top of the window frame; a sill plate 104—main horizontal part forming the bottom horizontal part of the frame 30 of a window, a piece that runs along the base of the window frame 30; a top rail 110—upper horizontal piece of a window sash; a bottom rail 112—lower horizontal piece of a window sash; and a sash 134—movable part of the window 30, the framework 134 that holds the glass 50 in place.

FIG. 9A through 9C are sketches of prior art showing more details of a typical window 32. The components demonstrated here are a typical window 32—wood, vinyl, aluminum, etc. as a stationary, single hung, double hung, side by side, pivot or tilt, etc. and a window, glass, pane, lite 50 can be single, double, triple with sealant 130 and inert gas 132, can be traditional, tempered or bullet proof. Additionally components shown include: a header 102—main horizontal part forming the top of the window frame; a sill plate 104—main horizontal part forming the bottom horizontal part of the frame 30 of a window, a piece that runs along the base of the window frame 30; a jamb 106—main vertical parts forming the sides of a window frame; an exterior casing 108—decorative molding or framing around a window 30 on the exterior to cover the space between the window frame or jamb 106 and the wall; an interior casing 109—decorative molding or framing around a window 30 on the interior to cover the space between the window frame or jamb 106 and the wall; a top rail 110—upper horizontal piece of a window sash; a bottom rail 112—lower horizontal piece of a window sash; a pull 114—handle for raising the lower sash 134 in a single- or double-hung window 30; a lock 116—locking mechanism used on a single- or double-hung window 30 that engages with the sash 134 to reduce rattling; a stile 118—the vertical part of a sash 134; an apron 120—piece attached to the wall beneath the sill 104; a stool 121—visible piece of wood, metal or stone attached to the sill 104 on which one might sit plants or other items; a muntin 122—actual bars that create a pattern in the window glass 50; a sealant between thermo windows (double, triple, etc.) panes 50; an inert, nontoxic gas 132 such as argon used in insulating glass units to reduce heat transfer; a sash 134—movable part of the window 30, the framework 30 that holds the glass 50 in place; a weather strip 136 (hidden, not shown)—strip of resilient material for covering the joint between the window sash 134 and frame 30 in order to reduce air leaks and prevent water from entering the structure; and a mullion 138 (not shown)—major structural vertical or horizontal piece that combines two or more windows 30 together.

FIG. 10A through 10D are additional sketches of prior art typical windows 32 with components and features. Many components were shown above. Here are shown: a typical window 32—wood, vinyl, aluminum, etc. as a stationary, single hung, double hung, side by side, pivot or tilt, etc. and a window, glass, pane, lite 50 can be single, double, triple with sealant 130 and inert gas 132, can be traditional, tempered or bullet proof. Likewise shown and portrayed are: a rough framing 100 for commercial or residential structures; Stop structures and means 101 to connect sills 104 and headers 102 to window 30 at top rails 43,53 and bottom rails 42,52—fasteners, adhesives, stop strips, and typical mechanical hardware (clips, nails, tacks, screws, etc.); a header 102—main horizontal part forming the top of the window frame; a sill plate 104—main horizontal part forming the bottom horizontal part of the frame 30 of a window, a piece that runs along the base of the window frame 30; a jamb 106—main vertical parts forming the sides of a window frame; a jamb liner 107—strip which goes on the sides of a window frame that provides a snug fit for the window sash; an exterior casing 108—decorative molding or framing around a window 30 on the exterior to cover the space between the window frame or jamb 106 and the wall; an interior casing 109—decorative molding or framing around a window 30 on the interior to cover the space between the window frame or jamb 106 and the wall; a bottom rail 112—lower horizontal piece of a window sash; a stile 118—the vertical part of a sash 134; an apron 120—piece attached to the wall beneath the sill 104; a stool 121—visible piece of wood, metal or stone attached to the sill 104 on which one might sit plants or other items; and a sash 134—movable part of the window 30, the framework 30 that holds the glass 50 in place.

The details mentioned here are exemplary and not limiting. Other specific components and manners specific to describing a window device 30 with a cement board as a frame material of the exterior surface may be added as a person having ordinary skill in the field of door and window devices and their uses well appreciates.

Operation of the Preferred Embodiment

The window device 30 with a cement board as a frame material of the exterior surface has been described in the above embodiment. The manner of how the device operates is described below. One notes well that the description above and the operation described here must be taken together to fully illustrate the concept. The preferred embodiment is a window device with a cement board as a frame material of an exterior section, the device is comprised of: (a) an interior section 33 (wood, aluminum, vinyl etc.) of the window device 30 with a cement board as a frame material comprising a pair of stiles 41, a bottom rail 42, and a top rail 43; (b) an exterior section 35 (cement board or equal) of the window device 30 with a cement board as a frame material comprising a pair of stiles 51, a bottom rail 52, and a top rail 53; (c) a means 40 to secure/connect such as adhesive, epoxy, exterior grade glue, fasteners, or integral molding the interior section 33 to the exterior section 35; (d) Stop structures and means 101 to connect top rails 43,53 and bottom rails 42,52 of the window 30 to a sill 104 and a header 102 of a rough framing 100 for commercial or residential structures, the means being such as fasteners, adhesives, stop strips, and typical mechanical hardware (clips, nails, tacks, screws, etc.); and (e) a jamb liner 107 strip which goes on the sides of the window 30 device that provides a snug fit for a window sash 134 of the window device 30 with a cement board to a pair of jambs 106 which are secured to the rough framing 100 for commercial or residential structures wherein the window device 30 is used as a new and/or a replacement window in a commercial or residential structure.

The window device 30 with a cement board as a frame material of the exterior surface is installed and operates somewhat like a typical window frame 32. The a window device 30 with a cement board as a frame material (which include the pair of stiles 41, 51; top rails 43,53; and bottom rails 42,52) mounted within a rough framing 100 for commercial or residential structures; Stop structures and means 101 to connect sills 104 and headers 102 to window 30 at top rails 43,53 and bottom rails 42,52—fasteners, adhesives, stop strips, and typical hardware; a header 102—main horizontal part forming the top of the window frame; a sill plate 104—main horizontal part forming the bottom horizontal part of the frame 30 of a window, a piece that runs along the base of the window frame 30; a jamb 106—main vertical parts forming the sides of a window frame; and a jamb liner 107—strip which goes on the sides of a window frame that provides a snug fit for the window sash. This is shown well in FIG. 7E.

Figures 7A, 7B, 7C, 7D, 7E:
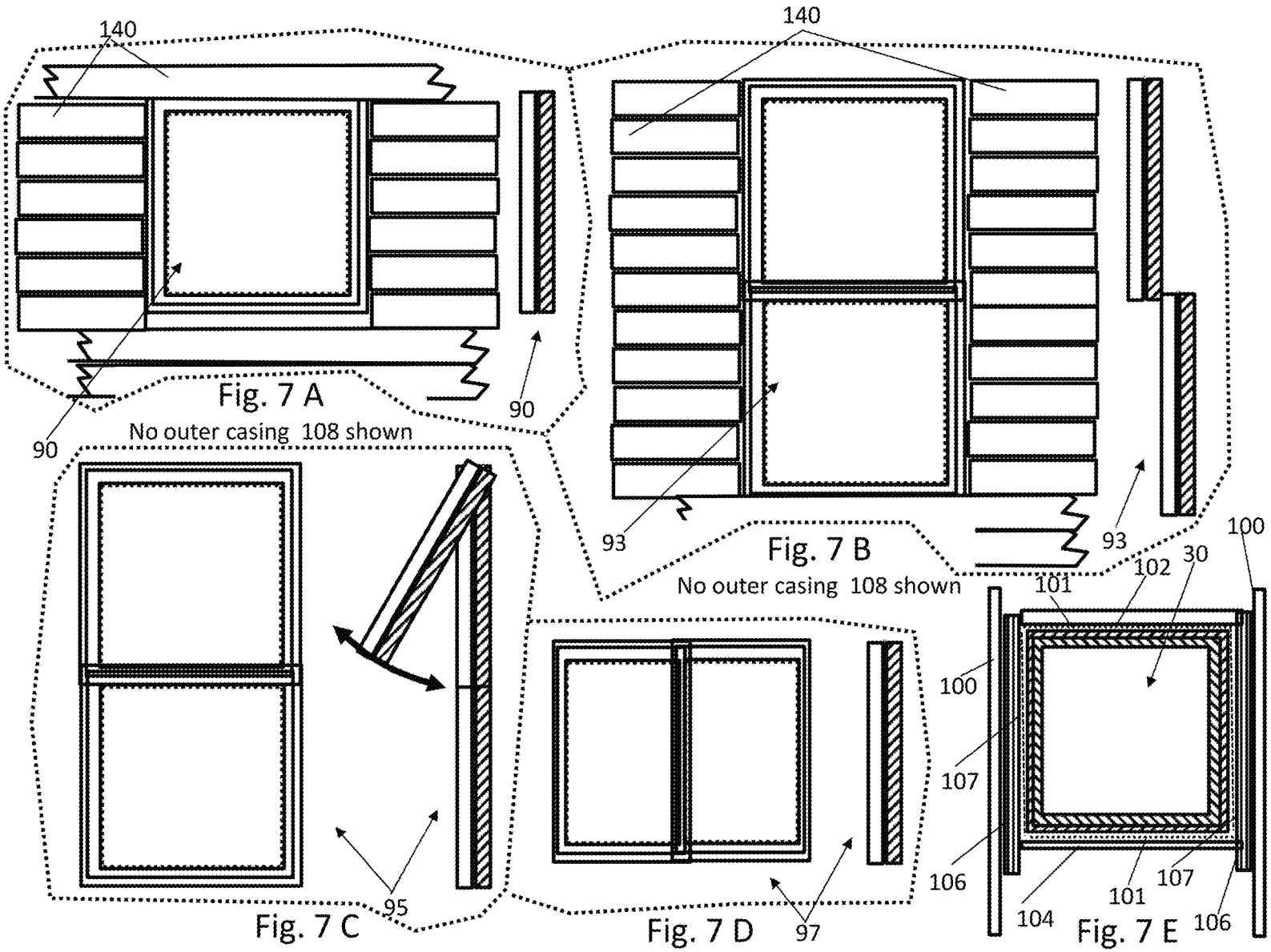

FIG. 7A through 7E are sketches of various uses for the window device 30 with a cement board as the exterior surface of the window device 30 frame material. Shown in these sketches are typical window configurations as examples and not as a limitation to the device 30. Below are various uses such as doors and other window and structures that can use the very same concept of the cementitious exterior. Depicted in these drawings are a single stationary 90 window frame of a window device 30 with a cement board as a frame material, an inoperable panel of a window; a double hung 93 window frame of a window device 30 with a cement board as a frame material; a tilt out/swing 95 window frame of a window device 30 with a cement board as a frame material; and a side-by-side 97 window frame of a window device 30 with a cement board as a frame material. Several show a typical structure with a series of siding panels 140. Not shown but understood by persons skilled in the art of window and door construction are an exterior casing 108—decorative molding or framing around a window 30 on the exterior to cover the space between the window frame or jamb 106 and the wall; an interior casing 109—decorative molding or framing around a window 30 on the interior to cover the space between the window frame or jamb 106 and the wall. FIG. 7E shows an example of a way that the window device 30 may be mounted into a rough opening 100. Here are depicted and shown: a window device 30 with a cement board as a frame material (which include the pair of stiles 41, 51; top rails 43,53; and bottom rails 42,52) mounted within a rough framing 100 for commercial or residential structures; Stop structures and means 101 to connect sills 104 and headers 102 to window 30 at top rails 43,53 and bottom rails 42,52—fasteners, adhesives, stop strips, and typical mechanical hardware (clips, nails, tacks, screws, etc.); a header 102—main horizontal part forming the top of the window frame; a sill plate 104—main horizontal part forming the bottom horizontal part of the frame 30 of a window, a piece that runs along the base of the window frame 30; a jamb 106—main vertical parts forming the sides of a window frame; and a jamb liner 107—strip which goes on the sides of a window frame that provides a snug fit for the window sash.

Many uses are anticipated for the concept shown with the window device 30 with a cement board as a frame material of the exterior surface. Some examples, and not limitations, are shown in the following Table.

| ITEM | DESCRIPTION |
|---|---|
| 1 | Stationary windows/single hung windows |
| 2 | Operating windows<br>Casement windows<br>Double -hung windows |
| 3 | Picture windows |
| 4 | Awning windows |
| 5 | Greenhouse windows |
| 6 | Bay windows |
| 7 | Pedestrian doors & door frames |
| 8 | Glass doors |
| 9 | Door frames for screen doors |
| 10 | Door frames for sliding doors and windows |
| 11 | Planters |
| 12 | Shadow boxes for designs on walls |

With this description it is to be understood that the window device 30 with a cement board as a frame material of the exterior surface is not to be limited to only the disclosed embodiment of product. The features of the special window device 30 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and, in its operation, can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. Various features and aspects of the disclosed embodiments can be combined with or substituted for one another to form varying modes of the disclosed inventions. Thus, it is intended that the scope of at least some of the present inventions herein disclosed should not be limited by the particularly disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed considering the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive in character, it being understood that only selected embodiments have been shown and described and that all changes, modifications and equivalents that come within the spirit of the disclosures described heretofore and or/defined by the following claims are desired to be protected.

What is claimed is:

1. A window device (30) comprised of:

(a) an interior section (33) made of a material and comprising a pair of stiles (41) of the interior section, a bottom rail (42) of the interior section, and a top rail (43) of the interior section whereby the interior section (33) surrounds a glass/pane (50) which is secured by a glazing/caulk/sealant (60);

(b) the exterior section (35) as a frame consists solely of a cementitious board comprising a pair of stiles (51) of the exterior section, a bottom rail (52) of the exterior section, and a top rail (53) of the exterior section whereby the exterior section (35) surrounds a glass/pane (50) which is secured by a glazing/caulk/sealant (60);

(c) a means (40) to secure and connect the interior section (33) to the exterior section (35);

(d) a stop structure (101) and means to connect the top rails (43,53) of the interior and exterior sections and bottom rails (42,52) of the interior and exterior sections to a sill (104) and a header (102) of a framing (100); and (e) a jamb liner (107) strip which is placed contiguous the pair of stiles (41,51) of the interior and exterior sections which provides a fit for a window sash (134) to a pair of jambs (106) which are secured to the framing (100)

wherein the window device (30) has multiple uses and wherein the window device due to the cementitious board is paintable and can be made as pre-painted panels.

2. The window device (30) in claim 1 wherein the material of the interior section (33) is selected from the group consisting of wood, aluminum, vinyl, plastic, and composite material.

3. The window device (30) in claim 1 wherein the means (40) to secure and connect the interior section (33) to the exterior section (35) is selected from the group consisting of adhesive, epoxy, exterior grade glue, fasteners, integral molding and forming.

4. The window device (30) in claim 1 wherein the stop structure and means to connect top rails (43,53) of the interior and exterior sections and bottom rails (42,52) of the interior and exterior sections to the sill (104) and the header (102) is selected from the group consisting of fasteners, adhesives, stop strips, and mechanical hardware.

5. The window device (30) in claim 4 wherein the mechanical hardware is selected from the group consisting of clips, nails, tacks, and screws.

6. The window device (30) n in claim 1 wherein the multiple uses are selected from a newly installed window and a replacement window.

7. The window device (30) in claim 1 wherein the multiple uses are selected from a window for a commercial structure and a window for a residential structure.

8. The window device (30) in claim 1 wherein the multiple uses is selected from a stationary single hung window, a casement window, a double-hung window, a picture window, a greenhouse window, a bay window, a door frame for a pedestrian door, a doorframe for a screen door, a doorframe for a sliding door, a shadow box on a wall for a design.

9. A window device (30) comprised of:

(a) an interior section (33) made of a material and comprising a pair of stiles (41) of the interior section, a bottom rail (42) of the interior section, and a top rail (43) of the interior section whereby the interior section (33) surrounds a glass/pane (50) which is secured by a glazing/caulk/sealant (60);

(b) the exterior section (35) as a frame consists solely of a cementitious board comprising a pair of stiles (51) of the exterior section, a bottom rail (52) of the exterior section, and a top rail (53) of the exterior section whereby the exterior section (35) surrounds a glass/pane (50) which is secured by a glazing/caulk/sealant (60);

(c) a specific manner of production as a means (40) to secure and connect the interior section (33) to the exterior section (35);

(d) a stop structure (101) and means to connect top rails (43,53) of the interior and exterior sections and bottom rails (42,52) of the interior and exterior sections to a sill (104) and a header (102) of a framing (100); and (e) a jamb liner (107) strip which is placed contiguous the stiles (41,51) which provides a fit for a window sash (134) to a pair of jambs (106) which are secured to the framing (100)

wherein the window device (30) is used for multiple uses in residential structures and wherein the window device due to the cementitious board is paintable and can be made as pre-painted panels.

10. The window device (30) in claim 9 wherein the stop structure and means to connect top rails (43,53) of the interior and exterior sections and bottom rails (42,52) of the interior and exterior sections to the sill (104) and the header (102) is selected from the group consisting of fasteners, adhesives, stop strips, and mechanical hardware.

11. The window device (30) in claim 9 wherein the multiple uses is selected from a stationary single hung window, a casement window, a double-hung window, a picture window, a greenhouse window, and a bay window.

12. The window device (30) in claim 9 wherein the specific manner of production is selected from the group consisting of an integral molded production method and a cast production method.

13. A window device (30) comprised of:

(a) an interior section (33) made of a material and comprising a pair of stiles (41) of the interior section, a bottom rail (42) of the interior section, and a top rail (43) of the interior section whereby the interior (33) section surrounds a glass/pane (50) which is secured by a glazing/caulk/sealant (60);

(b) the exterior section (35) as a frame consists solely of a cementitious board comprising a pair of stiles (51) of the exterior section, a bottom rail (52) of the exterior section, and a top rail (53) of the exterior section whereby the exterior (35) section surrounds a glass/pane (50) which is secured by a glazing/caulk/sealant (60);

(c) a specific manner of production as a means (40) to secure and connect the interior section (33) to the exterior section (35);

(d) a stop structure (101) and means to connect top rails (43,53) of the interior and exterior sections and bottom rails (42,52) of the interior and exterior sections to a sill (104) and a header (102) of a framing (100); and (e) a jamb liner (107) strip which is placed contiguous the stiles (41,51) which provides a fit for a window sash (134) to a pair of jambs (106) which are secured to the framing (100)

wherein the window device (30) is used for multiple uses as replacement windows for residential structures and wherein the window device due to a cementitious board is paintable and/or can be made as pre-painted panels.

14. The window device (30) in claim 13 wherein the stop structure and means to connect top rails (43,53) of the interior and exterior sections and bottom rails (42,52) of the interior and exterior sections to the sill (104) and the header (102) is selected from the group consisting of fasteners, adhesives, stop strips, and mechanical hardware.

15. The window device (30) in claim 13 wherein the multiple uses is selected from the group consisting of a stationary single hung window, a casement window, a double-hung window, a picture window, a greenhouse window, a bay window, a door frame for a pedestrian door, a doorframe for a screen door, a doorframe for a sliding door, a shadow box on a wall for a design.

16. The window device (30) in claim 13 wherein the specific manner of production is selected from the group consisting of an integral molded production method and a cast production method.

* * * * *